US005270739A

United States Patent [19]

Kitani et al.

[11] Patent Number: 5,270,739

[45] Date of Patent: Dec. 14, 1993

[54] LIQUID CONTAINER HAVING AN ELASTIC DOME-SHAPED PRESSURE CONTROL DEVICE WITH A SLIT

[75] Inventors: Masashi Kitani, Yokohama; Yoshifumi Hattori, Yamato; Etsurou Suzuki, Yokohama; Hideo Saikawa, Kawasaki; Masami Kojima; Kenji Kawano, both of Tokyo; Koichi Tanno; Kenji Aono, both of Kawasaki, all of Japan

[73] Assignee: Canon Kabushiki Kaisha, Tokyo, Japan

[21] Appl. No.: 824,572

[22] Filed: Jan. 23, 1992

[30] Foreign Application Priority Data

| | | | |
|---|---|---|---|
| Jan. 25, 1991 | [JP] | Japan | 3-007759 |
| Jan. 25, 1991 | [JP] | Japan | 3-007760 |
| Jan. 25, 1991 | [JP] | Japan | 3-007761 |
| Jan. 25, 1991 | [JP] | Japan | 3-007769 |

[51] Int. Cl.[5] ..... B41J 2/01

[52] U.S. Cl. ..... 346/140 R

[58] Field of Search ..... 346/75, 140 R; 400/126

[56] References Cited

U.S. PATENT DOCUMENTS

| | | | |
|---|---|---|---|
| 4,074,284 | 2/1978 | Dexter et al. | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,500,895 | 2/1985 | Buck et al. | 346/140 R |
| 4,509,062 | 4/1985 | Low et al. | 346/140 R |
| 4,558,333 | 12/1985 | Sugitani | 346/140 R |
| 4,610,202 | 9/1986 | Ebinuma et al. | 101/364 |
| 4,677,447 | 6/1987 | Nielsen | 346/140 R |
| 4,680,696 | 7/1987 | Ebinuma et al. | 346/75 |
| 4,719,475 | 1/1988 | Kiyohara et al. | 346/140 R |
| 4,723,179 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,928,126 | 5/1990 | Asai | 346/140 R |
| 5,008,688 | 4/1991 | Ebinuma et al. | 346/140 R |
| 5,040,001 | 8/1991 | Dunn et al. | 346/140 R |

FOREIGN PATENT DOCUMENTS

| | | |
|---|---|---|
| 375383 | 6/1990 | European Pat. Off. . |
| 3504216 | 8/1985 | Fed. Rep. of Germany . |
| 54-56847 | 5/1979 | Japan . |
| 59-123670 | 7/1984 | Japan . |
| 59-138461 | 8/1984 | Japan . |
| 60-71260 | 4/1985 | Japan . |
| 2063175 | 6/1981 | United Kingdom . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A liquid container includes a liquid outlet for supplying liquid, a pressure control device disposed in the container and adjacent to the outlet The pressure control device has a value function for permitting liquid supply through the outlet within a predetermined pressure range.

13 Claims, 11 Drawing Sheets

LIQUID CONTAINER HAVING AN ELASTIC DOME-SHAPED PRESSURE CONTROL DEVICE WITH A SLIT

FIELD OF THE INVENTION AND RELATED ART

The present invention relates to a liquid container, an ink cartridge integrally having a recording head for a ejecting ink for recording operation and an ink container. The ink cartridge is detachably mountable on a recording apparatus, and an ink jet recording apparatus usable with the ink cartridge.

An ink jet cartridge comprising a recording head provided with means for generating energy contributable to ejection of ink droplets and an ink container for containing the ink to be supplied to the recording head wherein the ink jet cartridge is detachably mountable to a recording apparatus, is known.

FIGS. 15 and 16 show an example of such an ink jet cartridge. The ink jet cartridge shown in FIG. 15 and disclosed in Japanese Laid-Open Patent Application No. 87242/1988 (U.S. Pat. No. 4,771,295) comprises an integral recording head 300 and ink container 1100. The recording head comprises a heater board 301 on which electrothermal transducer elements are formed, a top plate 302 for constituting ink passages corresponding to the electrothermal transducers, an M-shaped spring 303 for clamping the heater board 301 and the top plate 302, a connecting member 304 for constituting ink supply passage for supplying the ink from the ink container, an electrode board 305 for applying recording signals to the electrothermal transducer elements, and an aluminum plate 306 for supporting the above elements. The ink container 1100 contains therein a compressed absorbing material 900 in the form of a porous material impregnated with the ink. The ink cartridge shown in FIG. 16 and disclosed in Japanese Laid-Open Patent Application No. 98857/1984 (U.S. Pat. No. 4,509,062) and Japanese Laid-Open Patent Application No. 207263/1984 (U.S. Pat. No. 4,500,895), is provided with an ink bladder 1000 of rubber material in the ink container 1100, the ink bladder containing the ink.

In this structure, the ink in the ink container is supplied out by a vacuum in the recording head resulting from the ink ejection and the capillary force of the ink passage in accordance with the ink consumption through the ink supply port and through the common liquid chamber. Therefore, the ink absorbing material and the rubber bladder are required to be such that the ink can be sufficiently retained, that the ink can be sufficiently supplied to the ejecting portion and that it provides proper ink retaining force (vacuum) to prevent unintentional leakage of the ink through the ejection outlets. To meet the requirements, the absorbing material has to have controlled size pores. The rubber bladder has to have an optimum thickness and shape.

In either case of the absorbing material or rubber bladder, when the of the ink container is lower than a predetermined level the ink leaks through the ejection outlet, or the inside vacuum increases with the consumption of the ink. If the increase exceeds a predetermined level, the ink ejecting properties are influenced with the result of degraded print quality or ejection failure. In such an occasion, all of the ink in the ink container is not used up, and some ink remains in the container. Where the ink is absorbed in an absorbed material, the amount of ink contained in the container is low, and therefore, the volume efficiently is lower than in the case of the bladder. On the other hand, where the rubber bladder is used, and when the cartridge is reciprocated to scan the recording material, the carriage movement carrying the cartridge causes a pressure variation, thus applying impact to the ink contained therein. If this occurs, the pressure in the bladder instantaneously increases with the result of promoting ink leakage through the ejection outlets. Accordingly, it has been difficult to realize a small size ink jet cartridge capable of containing a large quantity of the ink and permitting substantially all of the ink therein to be used up. In the case of using the absorbing material, the large capacity leads to a large ink container, and where the rubber bladder is used, it is easily influenced by impact. For these reasons, the large capacity ink container has been difficult in either case.

SUMMARY OF THE INVENTION

Accordingly, it is a principal object of the present invention to provide an ink container, an ink jet recording head cartridge and an ink jet recording apparatus, in which the ink container has a large capacity and is capable of stably supplying the ink.

It is another object of the present invention to provide an ink container capable of permitting substantially all of the ink therein to be used up.

According to an aspect of the present invention, there is provided a liquid container, an ink jet cartridge integral with the ink container and an ink jet recording apparatus usable with the cartridge, wherein said liquid container comprises an ink supply outlet, and a pressure control means with the function of a valve for permitting supply of the liquid within a predetermined pressure range.

According to another aspect of the present invention, there is provided a liquid container, an ink jet recording cartridge having a recording head and integral with the liquid container, and an ink jet recording apparatus usable with the cartridge, wherein the liquid is supplied as desired, and said container comprises a bladder of an elastic material in the form of a hollow dome adjacent a supply outlet of the container, and said bladder is provided with a slit which opens deformation of the bladder by a predetermined vacuum and is closed by reduction of the vacuum, wherein said container is provided with limiting means for limiting deformation of the bladder in one direction.

According to a further aspect of the present invention, there is provided a liquid container, an ink jet recording cartridge having a recording head and an integral ink container and an ink jet recording apparatus usable with the cartridge, wherein the ink container permits the liquid to be supplied as desired, and is provided with an elastic material bladder in the form of a hollow dome adjacent an ink supply outlet, wherein the bladder is provided with a plurality of slits opened by deformation of the bladder by a predetermined vacuum and closed by reduction of the vacuum.

In these aspects of the present invention, the pressure control means with the valve function is in the form of one or more slits defined by the elastic member, in which the slit or slits are closed in normal state but are opened when a difference between an internal pressure and the external pressure exceeds a predetermined level. The pressure control means is effective to limit the pressure of the liquid to the nozzle to within a predetermined pressure range thus permitting stabilized ink supply to the recording head or the like.

The ink supply is further stabilized and assured by the member permitting deformation only in one direction or by the provision of plural slits, or by the provision of a recess along the slit.

According to those aspects, the vacuum in the ink container is not needed to be large, and the volume of the bladder is not needed to be large, and therefore, the capacity of the ink container is increased without deteriorating immunity to the impact. Therefore, the volume efficiency of the ink container is remarkably increased.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiment 1

Figure 1:
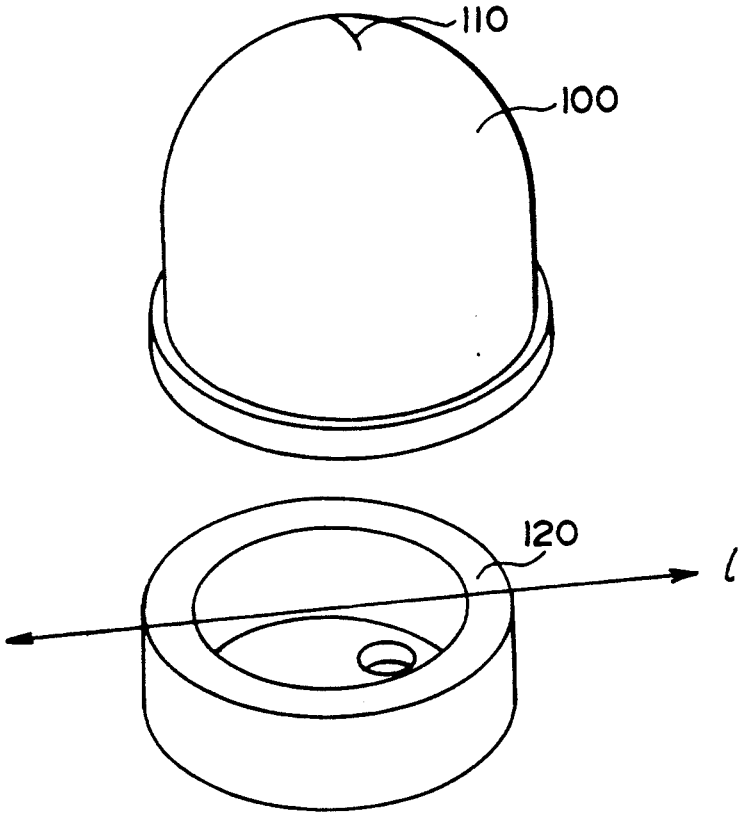
FIG. 1 is an exploded perspective view of a slit bladder according to an embodiment of the present invention.
Figure 2:
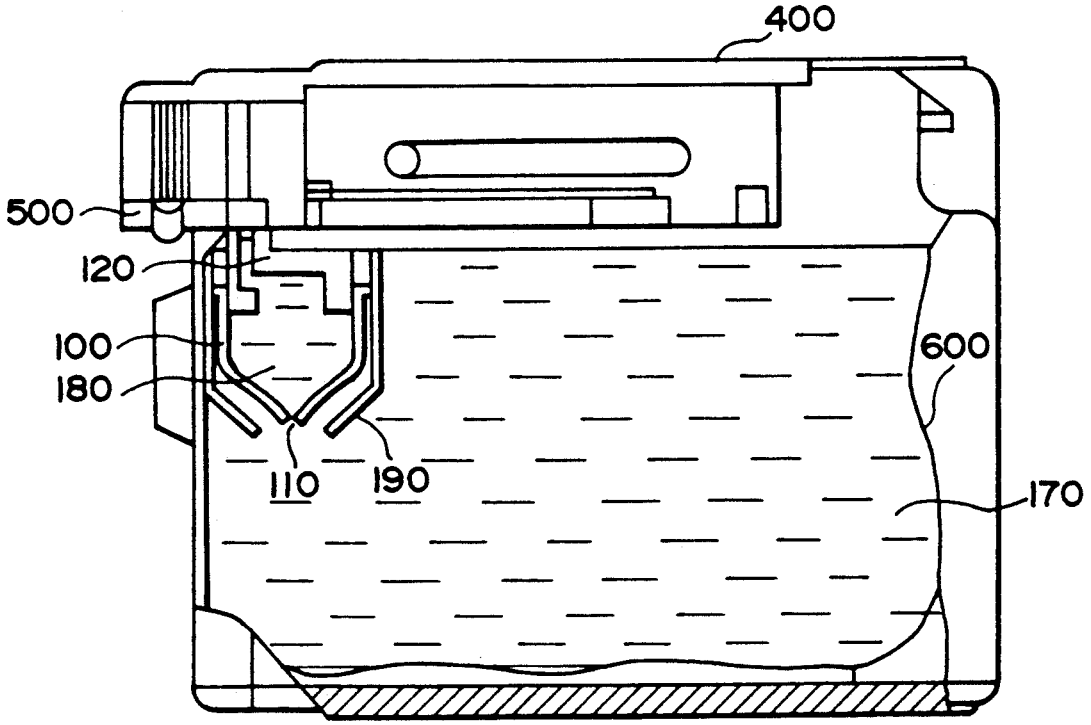
FIG. 2 is a sectional view of an ink cartridge incorporating the slit bladder according to the first embodiment, in which the slit is closed.
Figure 3:
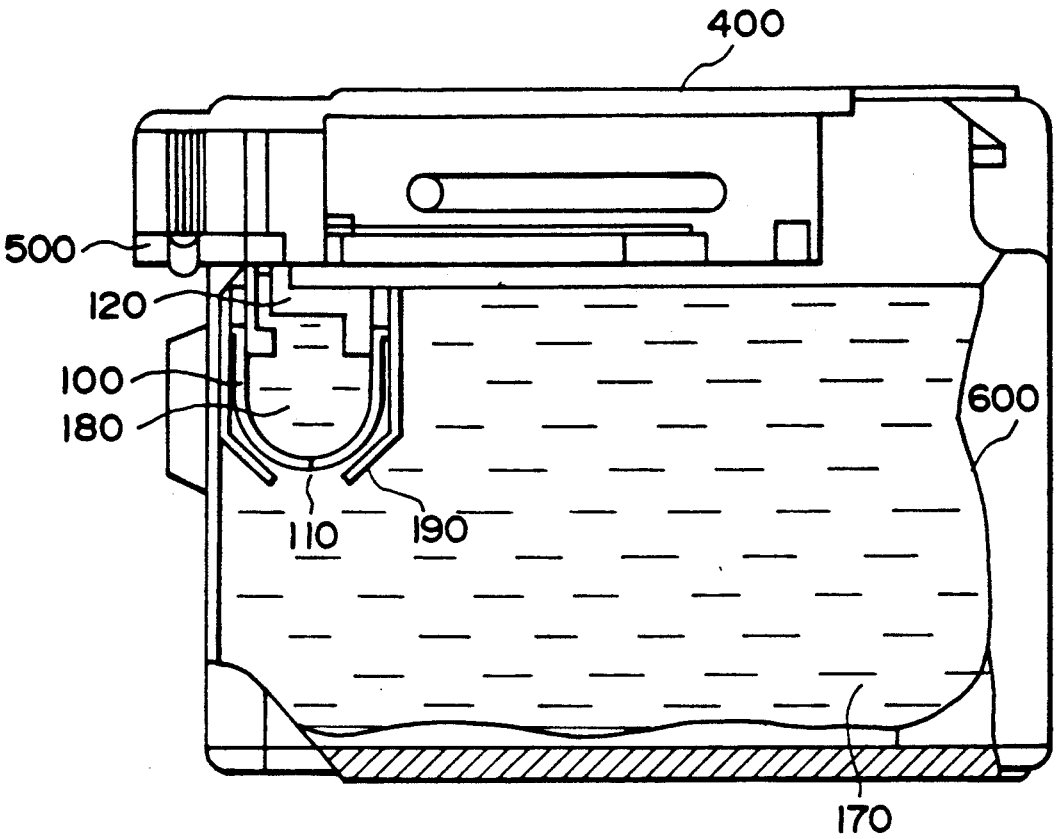
FIG. 3 is a sectional view of an ink cartridge incorporating the slit bladder according to the first embodiment, in which the slit is opened.

Referring to FIGS. 1, 2 and 3, there is shown a bladder with a slit, according to a first embodiment of the present invention. The slitted bladder 100 is mounted on a mount 120. FIGS. 2 and 3 show an ink cartridge having an integral recording head and an ink container in the form of the slitted bladder.

The bladder 100 is provided with a slit 110 and is mounted on the bladder mount 120. The mounting portion of the mount 120 conforms the outer peripheral shape of the base portion of the bladder and is oval. The slit 110 extends in a direction substantially perpendicular to the major axis 1 of the oval shape. By doing so, the tension force in the side wall of the bladder is different in the major axis direction of the oval shape of the mount 120 than in the minor axis direction, thus promoting collapse of the bladder, so that the slit is easily opened in response to pressure change resulting from ink supply in accordance with ink consumption by the recording head.

However, the angle of the slit may be deviated by 0–55 degrees from 90 degrees.

Figure 4:
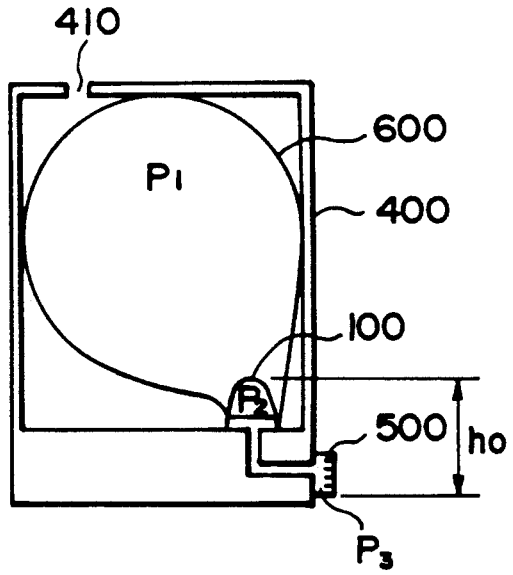
FIG. 4 is a schematic view in which the slit bladder of the first embodiment is mounted in an ink jet head cartridge.

FIG. 4 shows an ink container head cartridge using the slitted bladder.

The slit 110 formed at the top of the slitted or slit bladder 100 is normally closed as shown in FIGS. 1 and 3. In such a situation, the pressure P2 in the slit bladder 100 is smaller than an external pressure P1 of the slit bladder.

With the ejection of the liquid droplets from the recording head 500, the internal pressure P2 decreases, and therefore, the wall of the bladder collapses inwardly as shown in FIG. 2. When the pressure difference between the internal pressure P2 and the external pressure P1 exceeds a predetermined level a, the slit 110 opens, permitting the ink flowing into the slit bladder 100 from the ink container 600.

With the introduction of the ink, the pressure difference between P2 and P1 decreases, and the bladder restores gradually. At a certain point of the process of the restoration, the slit 110 closes. In this manner, the slit 110 closes and opens so that the internal pressure P2 of the slit bladder satisfies the following equation:

$$P1-a \leqq P2 < P1 \quad (1)$$

(a: constant)

To the recording head 500, the static head $h_0$ by the ink present between the slit bladder 100 and the recording head 500, and the pressure in the recording head 500 is:

$$P2+h_0 \quad (2)$$

When $P2+h_0$ exceeds +30 mm.aq (static head of water) the ink may leak through the nozzle, or density change may occur. If it is too small on the contrary, the vacuum is too large with the result of ejection failure or reduction of the ejected droplet volume.

In order to avoid these problems, $-200$ mm.aq $< P2+h_0 \leqq +30$ mm.aq, is preferable; further preferably, $-150$ mm.aq $< P2+h_0 <= 0$.

In the FIGS. 2 and 3 example, the recording head is integral with the ink container, and these FIGS. show partial sectional views of the ink jet head cartridge having the ink container in the form of the slitted bladder. Designated by reference 600 is an outer bladder for containing the ink and is made of a flexible material. The outside of the large ink bladder communicates with the ambience through an unshown air vent. In FIG. 3, the slit 110 is shown as being closed. A main ink containing chamber 170 and a sub-container chamber 180 are isolated by the slitted bladder. At this time, the slit bladder 100 is completely restored or slightly collapsed. The liquid pressure applied to the nozzle of the recording head 500 is adjusted so as not to exceed +30 mm.aq. In other words, the adjustment is effected so as to maintain the balance between the meniscus retaining force at the ejection outlet and the internal pressure of the ink container, and therefore, the ink is not easily leaked out even by temperature or pressure variation or vibration or the like.

When the pressure in the subordinate chamber 180 exceeds the pressure in the main chamber 170, the slit 110 opens, and therefore, is effective to reduce the pressure difference therebetween.

Figure 5:
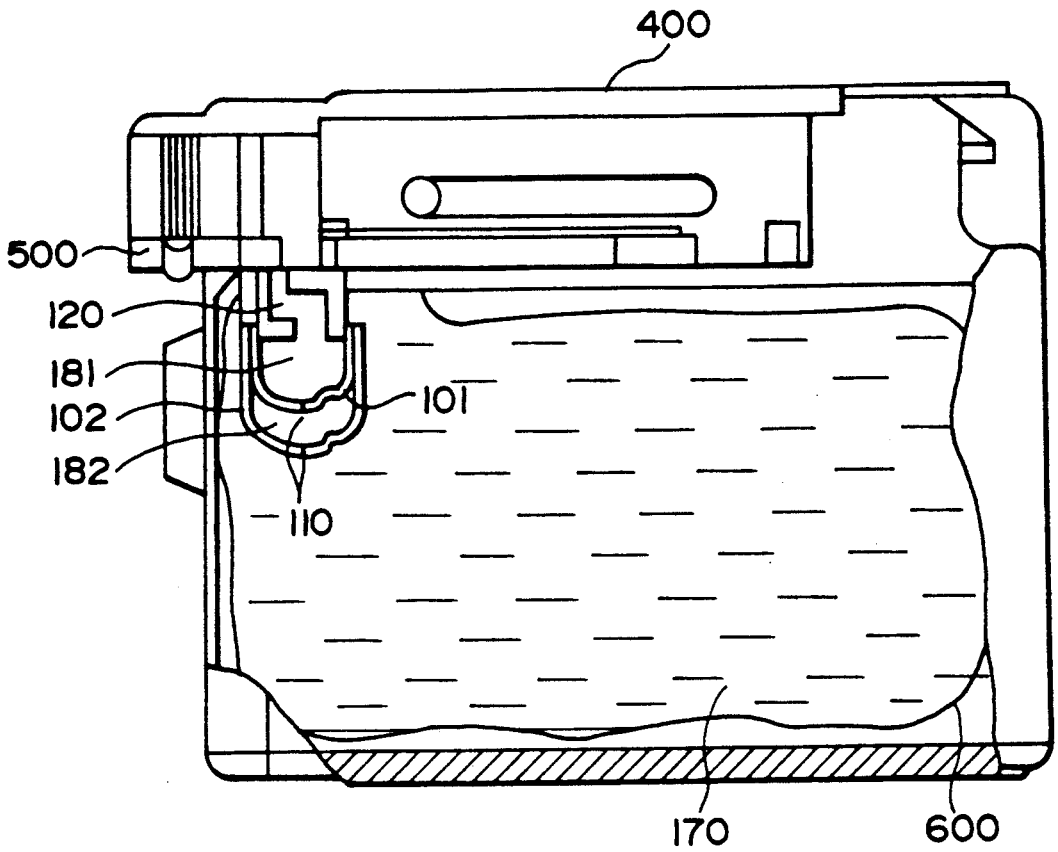
FIG. 5 is a sectional view of an ink jet cartridge incorporating a slit bladder according to a second embodiment of the present invention.

With the consumption of the ink in the subordinate chamber 180 by ejection of the droplets by the recording head, the internal pressure of the subordinate chamber 180 reduces, so that the slitted bladder 100 collapses, as shown in FIG. 5.

In this manner, when the pressure difference between the subordinate chamber 180 and the main chamber 170 exceeds a predetermined level, the slit 110 opens as shown in FIG. 2 by the collapse of the slit bladder 100 itself, by which the ink in the container flows from the main container 170 to the subordinate container 180, and therefore, the pressure difference between the subordinate chamber 180 and the main chamber 170 gradually decreases. With the reduction of the pressure difference therebetween, the slit bladder 100 restores gradually, and the slit 110 closes. At this time, the pressure in the subordinate chamber 180 is lower than that in the main chamber 170. Therefore, during the printing operation, the closed slit state of FIG. 3 and the open slit state of FIG. 2 appears repeatedly. In the normal state, the slit 110 of the bladder 100 is closed, as shown in FIG. 3. On the other hand, when the ink is sucked out through the nozzle temporarily by a sucking pump or the like, the pressure difference between the subordinate chamber 180 and the main chamber 170 increases similarly to the printing operation, and therefore, the slit 110 opens, and the normal state is restored sooner or later. In order to provide the stabilized ink droplet ejections, the ink pressure to the recording head 500 is preferably +30 --200 mm.aq, further preferably 0 --150 mm.aq. It is desired that the pressure of the subordinate chamber 180 is controlled to provide such a pressure, and therefore, that the material (hardness) and/or the configuration of the bladder 100 and the shape or the like of the slit 110.

A confining wall 190 functions to confine the swinging motion of the slit bladder 100 against reciprocal movement of the carriage, so as to be free from the influence of the cartridge scan.

The bladder in this embodiment is made of elastic material having a hardness of 15-70 degrees, preferably 25-50 degrees, the hardness is defined in hardness test (A mode), and is hereinafter expressed as "JIS A". Since the slit bladder is in contact with the ink in the ink container, the material of the slit bladder is desirably such that it does not change the properties (surface tension viscosity, and the like) of the ink and that it does not dissolve into the ink. Simultaneously, the material is not changed by the ink in the properties thereof. Examples of usable materials include silicone rubber, SBR, BR, IR, EPM, EPDM, butyl rubber, chloroprene rubber, urethane rubber, fluorine rubber, nitrile rubber, polysulfide rubber, ethylene rubber, chlorosilicone rubber, SEP rubber (silicone ethylene propylene rubber) or the like, provided that the above-described rubber hardness and other conditions.

The materials should not change the properties (surface tension, viscosity and the like) of the ink, since it is in contact with the ink in the ink container. In addition, it should not dissolve into the ink. In addition, the properties of the material should not be influenced by the ink.

The ink jet recording ink in this embodiment is as follows.

The dye of the ink may be almost any one of acetic dye, direct dye, basic dye and reactive dye listed in the color index. Although not listed in the color index, it is usable if it is water soluble.

The content of the dye in the ink is not particularly limiting, but usually it is 0.1-20 % by weight on the basis of the total ink weight, preferably 0.3-10 % by weight, and further preferably 0.5-6 % by weight.

The preferable liquid of the ink is water or a mixture of the water and water soluble organic solvent. Particularly preferable is a mixture of the water and a water soluble organic solvent, which may include polyatomic alcohol exhibiting preventing effect against ink drying. As for the water, it is preferably deionized water, rather than usual ion containing water.

The content of the water soluble organic solvent in the ink is generally 2-80 % by weight on the basis of the total weight of the ink, preferably 3 -70% by weight, and further preferably 4-40% by weight.

The water content in the ink is not less than 35 % by weight on the basis of the total ink weight. Preferably, it is not less than 45 % by weight. In addition to the above-described contents, the ink may contain an anti-mildew agent, an antispetic agent, a pH adjusting agent, a viscosity adjusting agent, a surface tension adjusting agent or the like.

The ink used in the present invention preferably has a viscosity at 25° C. of 1-20 cP, preferably 1 - 15 cP, a surface tension of not less than 30 dyne/cm, preferably not less than 40 dyne/cm, and pH of approximately 4-10.

Embodiment 2

FIG. 5 shows an ink jet head cartridge according to a second embodiment of the present invention incorporating a slitted bladder. In this embodiment, two slitted bladders are arranged in series.

In this embodiment, a pressure P3 in a first slitted bladder 101, a pressure P2 in a second slitted bladder 102 and a pressure P1 in the main chamber 120, satisfy the following equation:

$$P2-a \leqq P3 < P2 < P1 \quad (3)$$

(a: constant)

As will be understood from the above equation, the pressure P3 in the first slitted bladder 101 is significantly reduced as compared with the pressure P1 in the main chamber. This arrangement is particularly effective for the head cartridges having a large capacity ink container in which a large pressure difference is desirable, and the head cartridge which desirably has a high vacuum in the recording head. In this embodiment, two series slit bladders are used, but the number of the slit bladders may be 3, 4, 5 ... n with an increase in the above described advantageous effects.

Embodiment 3

Figure 6:
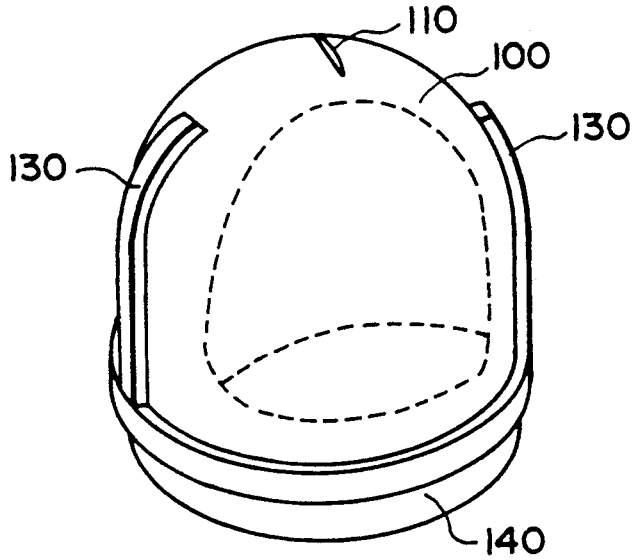
FIG. 6 is a perspective view of a slit bladder according to a third embodiment of the present invention, showing how the slit bladder collapses.

FIG. 6 shows a slit bladder according to a third embodiment of the present invention. In this embodiment, ribs 130 are formed by producing the slitted bladder with different thickness portions. The ribs 130 are effective to confine the direction of collapse of the bladder. The bladder is mounted on a mount 120 similarly to the foregoing embodiment, the mounting portion of the mount 120 conforms to the outer peripheral shape of the base portion of the bladder, which is circular in this embodiment.

In this embodiment, the ribs on the side wall of the slit bladder function to provide a difference in the tension of the side wall of the slit bladder. The angle formed between the slit and the ribs is substantially 90 degrees. However, the angle may be different by 0–55 degrees from 90 degrees.

Figure 7:
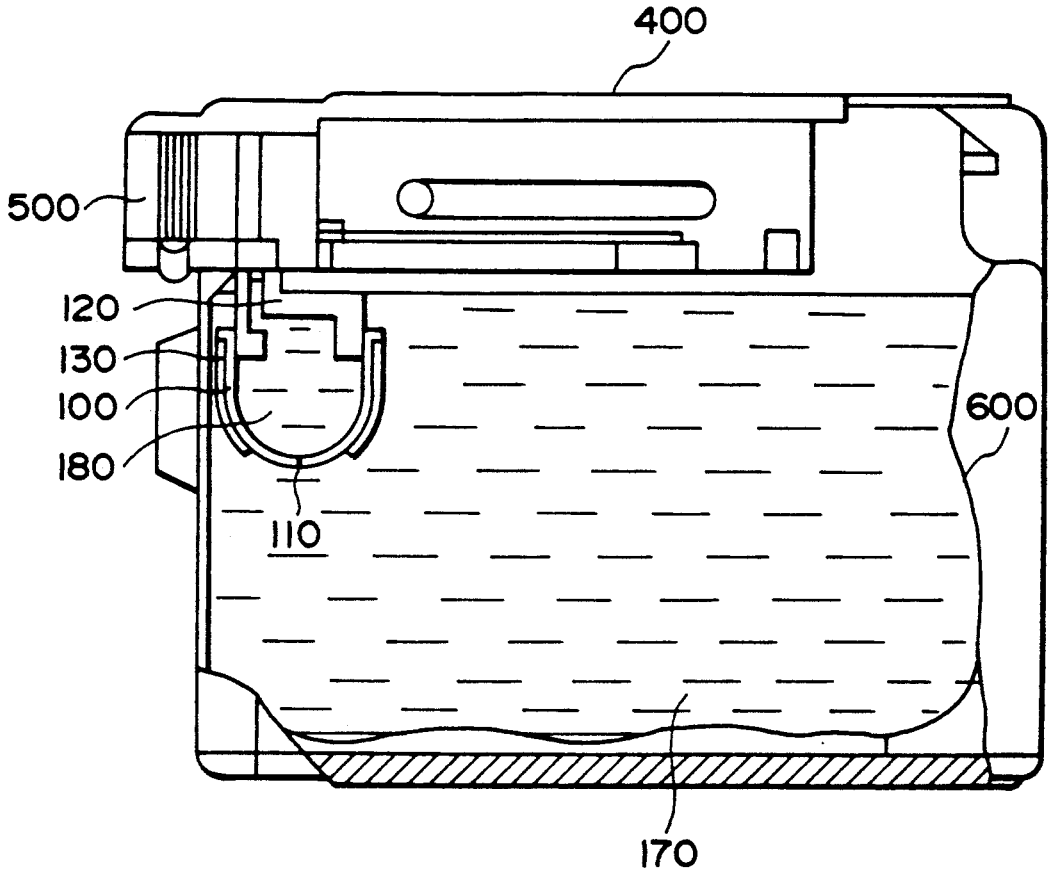
FIG. 7 is a sectional view of an ink jet cartridge incorporating the slit bladder according to the third embodiment of the present invention.

FIG. 7 is a sectional view of an ink jet head cartridge containing such an ink bladder with a slit. The inside and outside of the bladder is filled with the ink. In accordance with reduction of the ink by the consumption of the ink by the printing operation of the ink jet head cartridge, the pressure in the subordinate chamber 180 reduces, and the portions, without the rib, of the bladder collapses, by which the slit of the bladder opens by the deformation of the bladder. The pressure within the slitted bladder is smaller than the pressure outside thereof, and therefore, the ink is supplied into the bladder through the opened slit from the external ink container chamber. When the ink is supplied, the slit bladder restores to a certain extent from the collapse. When the pressure difference between the inside outside of the bladder drops below a predetermined level, the slit is closed. In accordance with the consumption of the ink by the printing operation, the above described actions are repeated, so that proper ink supply is accomplished. The vacuum in the slitted bladder oscillates within a predetermined range not influencing the ejection. In the case of the bladder with the ribs, the bladder may be mounted irrespective of the positional relation with the mount.

Figure 8:
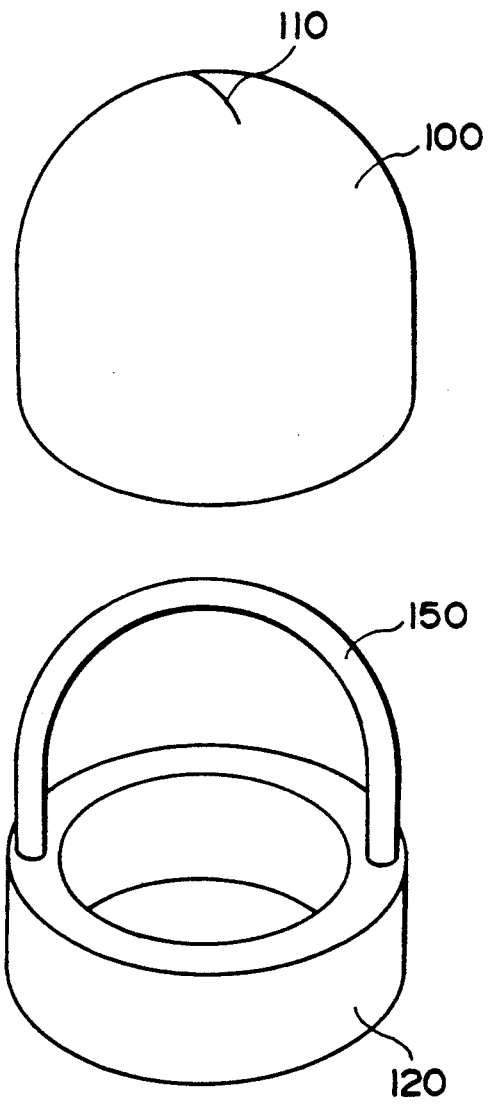
FIG. 8 is a schematic perspective view of a slit bladder which is a modification of the third embodiment.
Figure 9:
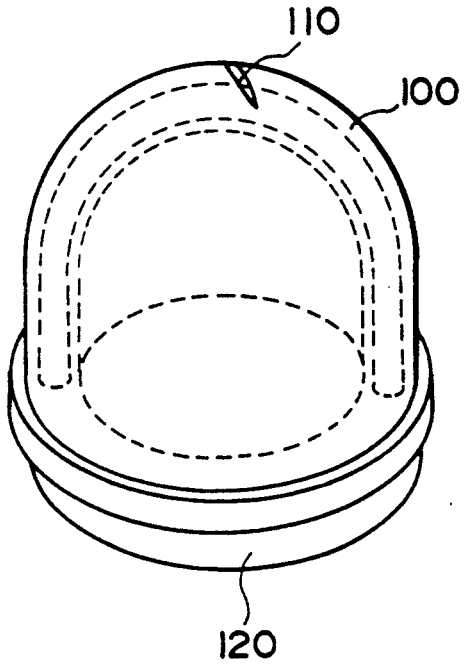
FIG. 9 is a perspective view of the slit bladder, showing how the bladder collapses.

The member for confining the direction of collapse of the bladder, may be established by changing the thickness of the bladder material. However, as shown in FIGS. 8 and 9, such a member may be mounted on the mount 120 for the bladder. It may be in the form of a frame 150 to be contained in the bladder. The same advantageous effects can be provided. In this case, the frame member 150 may be integrally formed with the mount, or may be a separate member mounted thereto. It is preferable that the frame member 150 preferably crosses with the slit within the range of crossing angles of 35–90 degrees. Embodiment 4

Figure 10A:
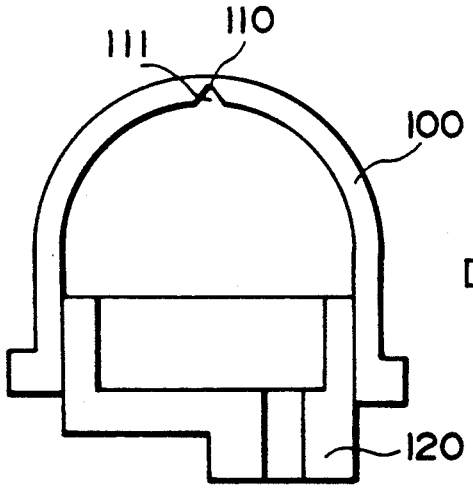
FIGS. 10A and 10B show opening and closing the slit of a slit bladder according to a fourth embodiment of the present invention.
Figure 10B:
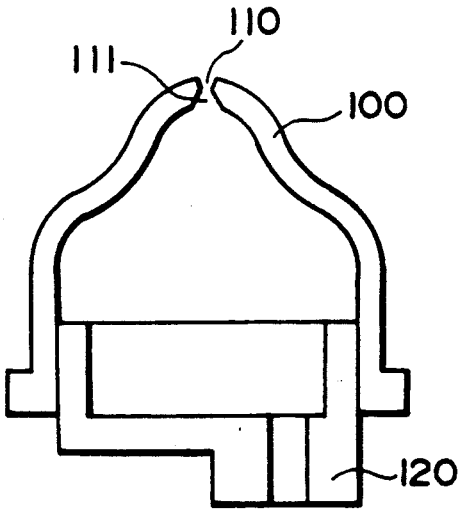
Figure 11:
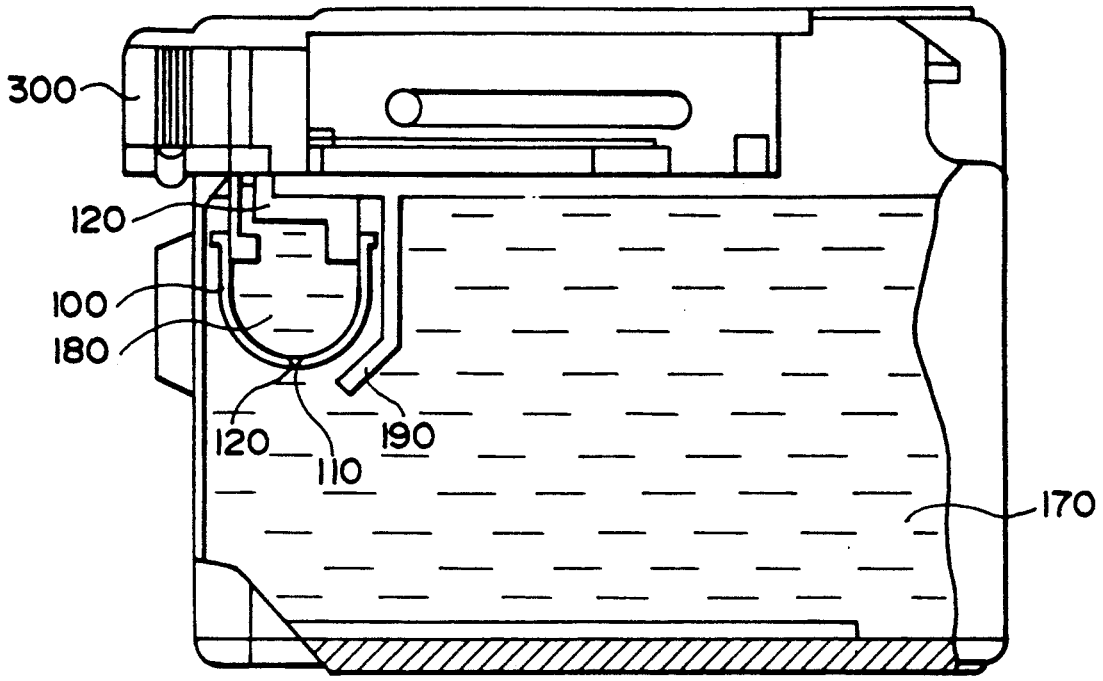
FIG. 11 is a sectional view of an ink jet cartridge incorporating a slit bladder according to the fourth embodiment of the present invention.

FIGS. 10A and 10B show a slitted bladder according to a fourth embodiment of the present invention. FIGS. 10A and 10B are sectional views illustrating a closed slit and an open slit, respectively. FIG. 11 is a sectional view of an ink jet cartridge having an integral recording head and an ink container. In FIGS. 10A, 10B and 11, a slit bladder 100 is made of silicone rubber and molded. The bladder 100 is provided with a slit 110 formed therein. The bladder is mounted on a mount 120, and the mounting portion of the mount conforms the outer peripheral shape of the base portion of the bladder, which is circular in this embodiment. In FIGS. 10A, 10B and 11, a conical recess is formed at the inside of the slit of the bladder. As shown in FIG. 11, there is provided a confining wall 190 for enclosing the slitted bladder to confine the swinging movement of the bladder. In this embodiment, the volume capacity of the bladder is small, and therefore, the influence of the carriage movement, such as vibration or impact is not so significant. However, in order to further ease the impact, the provision of the confining wall is preferable. The slitted bladder mounted on the mount is incorporated in the ink container of the ink jet cartridge. By doing so, the ink container is separated into a main container chamber 170 at the outside of the slitted bladder and a subordinate container chamber 180 at the inside of the slit bladder. Both of the chambers are filled with the ink. At this time, the bladder is completely restored as shown in FIG. 11 or is slightly collapsed. The liquid pressure to the recording head portion 300 is zero or slightly vacuum. With this state, the balance between the meniscus retaining force at the ejection outlets and the internal pressure of the ink container is maintained, and therefore, the ink does not leak through the nozzles even by ambient temperature or pressure changes or vibrations or the like. With this state, the liquid droplets are ejected from the recording head to effect the recording operation, so that the ink is consumed from the subordinate chamber 180, and the vacuum in the sub-chamber increases gradually, and therefore, the slitted bladder collapses. When the vacuum in the sub-chamber exceeds a predetermined level, the slit of the end portion of the bladder gradually opens in accordance with the deformation of the bladder, as shown in FIG. 10.

By the provision of the conical recess in the inside of the slit of the bladder, the conical recess assuredly opens, and therefore, the opening and closing of the slit is assured. The conical recess may be replaced by a short groove which is shorter than the length of the slit. When plural slits are used, each of the slits may be provided with grooves having a length shorter than that of the associated slit. Since the pressure in the sub-chamber is a vacuum, the ink is supplied from the main chamber outside the slitted bladder through the slit or slits into the sub-chamber. By such supply of the ink, the collapsed bladder restores to a certain extent, and then, when the vacuum in the sub-chamber reaches a predetermined level, the slit is closed. Therefore, in accordance with the process of the printing and the consumption of the ink, the above operations are repeated to accomplish the proper ink supply. In other words, the vacuum in the subordinate chamber repeatedly changes with a predetermined range not influential to the ejection.

Embodiment 5

Figure 12:
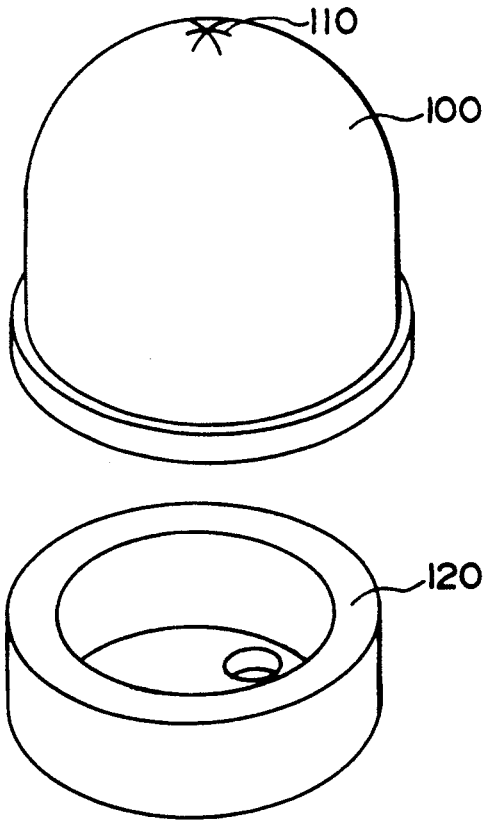
FIG. 12 is a perspective view of a slit bladder according to a fifth embodiment of the present invention.

FIG. 12 shows a slitted bladder according to a fifth embodiment of the present invention. In this FIGURE, there are shown a slitted bladder and a mount therefor. The bladder 100 is made of silicone rubber and molded. It is provided with three slits at the top end of the bladder, which cross with each other at the angle of 60 degrees. The bladder 100 is mounted on a mount 120. The mounting portion of the mount has a configuration conforming the outer peripheral shape the base portion of the bladder 100, which is circular, in this embodiment. In this embodiment, it is also preferable that when the bladder is disposed in the ink container, it is enclosed with a swing preventing wall. In this embodiment, the volume of the bladder is small, and therefore, it is rather immune to the vibration or impact by movement of the carriage or the like. However, in order to further ease the shock, the provision of the confining wall is preferable. In the normal state, the bladder mounted in the ink container is in the completely restored state or only slightly collapsed state, and therefore, the slits are not opened. At this time, the pressure to the liquid in the recording head nozzle is zero or slightly vacuum. Therefore, the balance is maintained between the meniscus retaining force at the ejection outlets and the ink container internal pressure, and therefore, the ink is not easily leaked through the nozzle by the temperature or ambient pressure change or vibration or the like. The liquid droplets are ejected out of the recording head to effect the printing operation, and therefore, the ink in the sub-chamber is consumed. As a result, the vacuum in the sub-chamber gradually increases, and the bladder with the slits collapses gradually. When the vacuum in the sub-chamber exceeds a predetermined level, the slits at the end of the bladder open in accordance with deformation of the bladder. In this embodiment, the bladder is provided with three slits at predetermined angles (at least one slit is inclined at an angle not more than 30 degrees), and therefore, the one or more slits opens irrespective of the direction of the collapse of the bladder, and therefore, the opening of the bladder is assured. Then, the ink is supplied from the main chamber outside the bladder through the opened slits into the sub-chamber, that is, the inside of the slitted bladder. By such supply of the ink, the vacuum in the sub-chamber gradually decreases. With the decrease of the vacuum in the sub-chamber, the collapsed bladder gradually restores. When it is restored to a certain extent, the slits closed. Therefore, with the process of the printing operation and the ink consumption, the above-described operations are repeated, and therefore, good ink supply is accomplished. Even when the ink is temporarily sucked by a sucking pump or the like for the purpose of maintaining or improving the ink ejection of the recording head, the pressure in the subordinate chamber becomes vacuum similarly to the case of the ink consumption during the printing operation, so that the bladder is collapsed with the result of the opening of the slit. Therefore, the ink is supplied from the main chamber to the sub-chamber. After the ink is supplied, the bladder restores to the initial state in which the slit is closed. Therefore, the vacuum in the bladder with the slits repeatedly changes within a predetermined range not influential to the ejection of the ink.

The material and the properties of the bladders in the foregoing embodiments are the same as in the first embodiment.

In the foregoing embodiments, the ink container may be opened to the ambience or may be closed. In the case of the closed system, it is desirable that the vacuum of the ink container is smaller than the vacuum in the slitted bladder at the time when the ink is used up.

Embodiment 6

Figure 13:
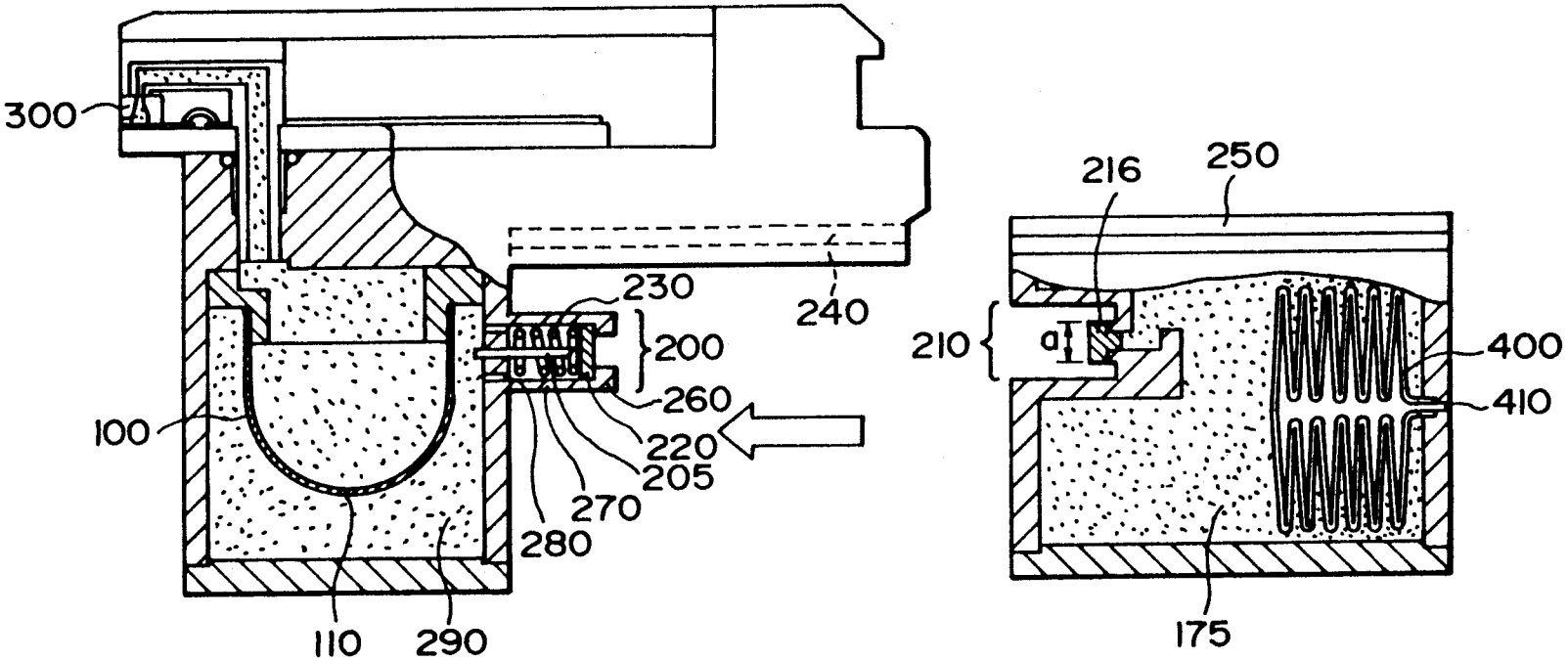
FIG. 13 is a section view of a separate recording head and ink container.

FIG. 13 shows an ink jet cartridge using a slitted bladder, according to a sixth embodiment of the present invention. In FIG. 13, the recording head and the ink container are detachable so as to permit the ink container to be replaced with another one when the ink container becomes empty of the ink. Designated by reference numerals 100, 110 and 200 are a slitted bladder, a slit and a connector of the recording head, respectively. Designated by reference numeral 210 is a connector of the ink container. In the connecting portion therebetween, an elastic member 220 is abutted to a stopper by a spring 230, and is contacted to the inside of a cylinder 270 in the recording head side. The cylinder 270 communicates with the sub-chamber 290 through a passage 280 and is filled with the ink in the subordinate chamber 290. An opening at an end of the cylinder 270 is closed by the elastic member 220, so that the ink is prevented from leaking out. In the cylinder 270, there is a connecting tube 205. in the form of a needle. The connecting tube 205 is always sub-merged in the ink, and therefore it is not contacted with air even when the ink container is not mounted, and therefore, the connecting tube or cannula is protected from clogging or the like due to evaporation of the ink.

When the ink container is inserted while a guide 240 of the main assembly gui a guide 250 of the ink container, elastic member 216 abuts the elastic member 220, since the elastic member 216 has a diameter a, and the elastic member 220 has a diameter a. When the ink container is further inserted, the needle tube 205 pierces the elastic member 220 coming, toward it by the insertion of the elastic member 216. When it is further inserted, the, needle tube 205 pierces the elastic member 216, too. The ink container is further inserted until an end surface of the stopper 260 abuts the end surface of the ink container connecting portion 210. Thus, the mounting of the ink container is completed. The length of the connecting needle tube 205, the position of the elastic member 216 of the ink container and the position of the stopper are so related that the ink communication is completely established when the ink container is completely mounted. The diameter of the elastic member 215 is smaller than the diameter of the opening of the stopper 260 to permit the insertion mounting.

In such a structure, the needle tube 205 can connect the ink container and the subordinate container without any contact with the external air. Because of this structure precluding contact of the connecting tube 205 with the ambient air, the air is not introduced into the recording head, so that the function of the slitted bladder is not deteriorated, and therefore, the stabilized function is assured. An inner ink container bladder 400 is made of flexible material. When the ink is consumed by ejection of the ink through the recording head with the result of reduction of the ink in the ink container, the air is introduced through an air vent 410 of the ink container inner bladder to permit it to expand, so that the pressure in the ink container is maintained constant. Designated by a reference numeral 175 is an ink cartridge for replacement, and 290 is a subordinate chamber.

In this embodiment, the slitted bladder is disposed in the subordinate container 290 in the recording head to provide an isolation between the ink cartridge 175 and the subordinate container 290. However, the isolating portion may be disposed between the subordinate container 290 and the recording head 300. It is a possible structure that the slitted bladder is in the ink cartridge.

Figure 14:
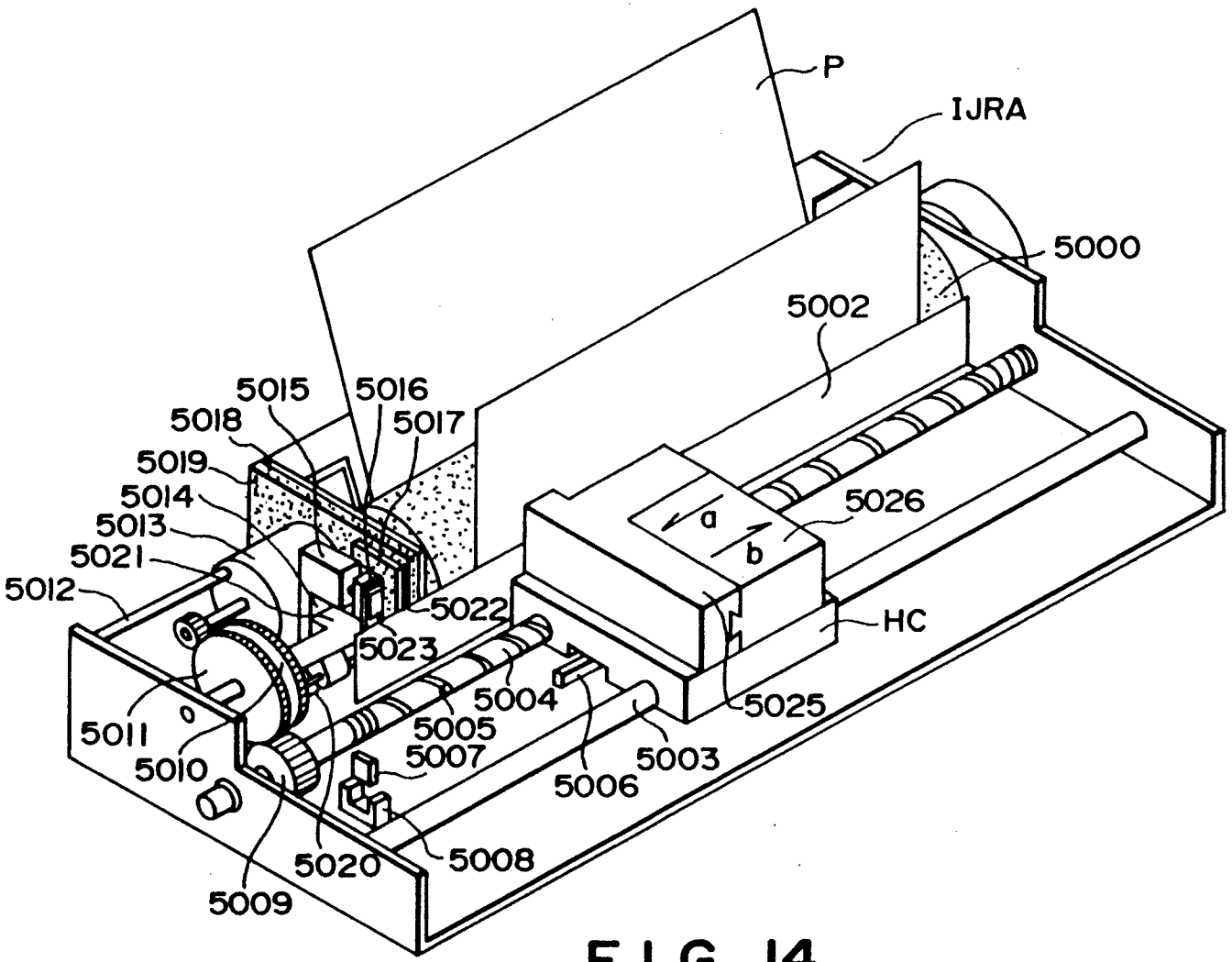
FIG. 14 is a perspective view of an ink jet recording apparatus according to an embodiment of the present invention.
Figure 15:
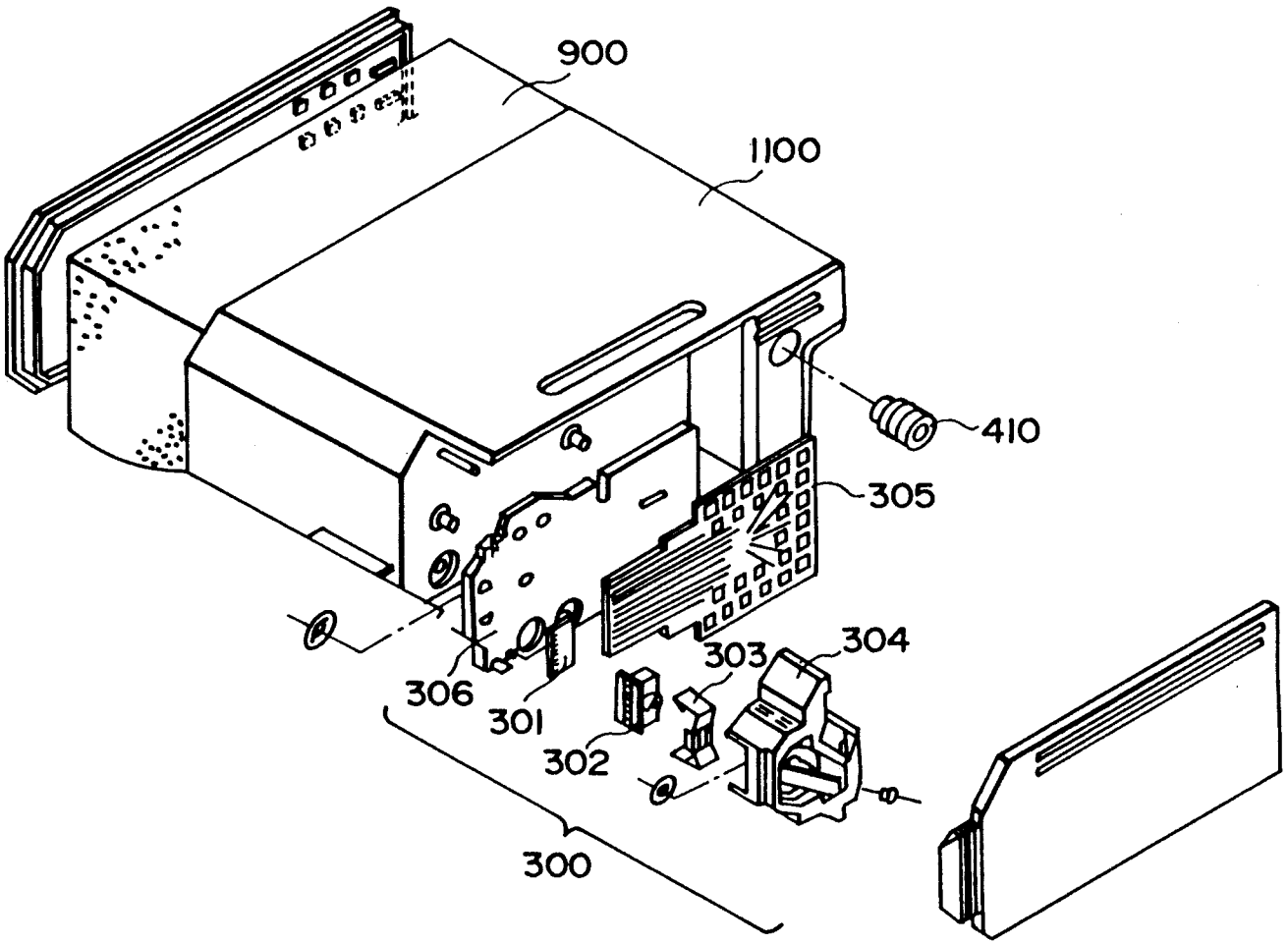
FIG. 15 and 16 are perspective views of a conventional ink jet cartridge.
Figure 16:
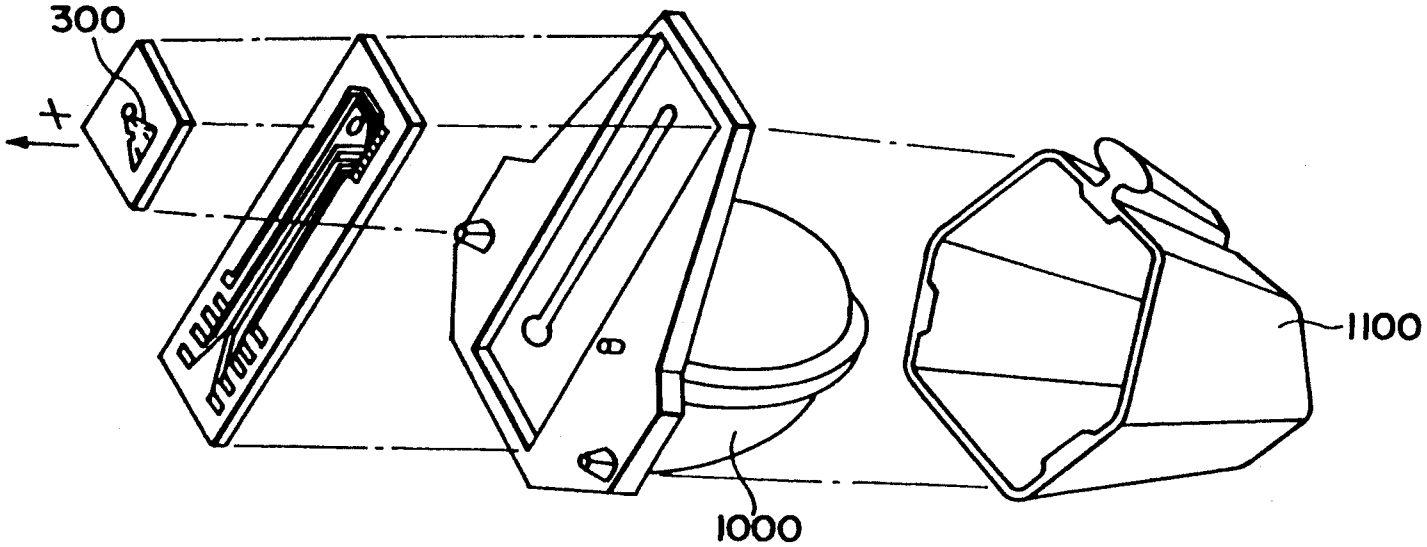

FIG. 14 shows a ink jet recording apparatus IJRA usable with the ink cartridge according to this invention. A carriage HC is engaged with a helical groove 5005 of a lead screw 5004 which is rotated by forward and backward rotation of the driving motor 5013 through drive transmission gears 5011 and 5009. The carriage HC is provided with a pin (not shown), and is reciprocated in directions a and b. A recording head 5025 and an ink container 5026 are mounted on the carriage HC. A sheet confining plate 5002 functions to confine the sheet on the platen 500 over a movement region of the carriage. A photocoupler comprising elements 5007 and 5008 is effective to detect presence of a lever 5006 of the carriage HC to switch the rotational direction of the motor 5013, that is, it is a home position detecting means. A supporting member 5016 functions to support a capping member 5022 for capping the ejection side surface (front side) of the recording head. A sucking means 5015 functions to suck the air or ink in the cap so as to recovery the recording head through the opening 5023 of the cap. The apparatus comprises a cleaning blade 5017 and a member 5019 for supporting the cleaning blade 5017 for front and rear movement. They are supported on the supporting plate 5018. The blade may be replaced with any other known cleaning member. A lever 5012 permits start of the recovery sucking operation and is moved with movement of a cam 5020 engaged with the carriage HC. For this movement, the driving force from the driving motor is transmitted through known transmitting means including a clutch or the like.

The capping, cleaning and the sucking recovery operation are permitted by the lead screw 5004 when the carriage HC is at the home position region. These operations may be carried out at known timing, and this embodiment is usable for such a timing.

The present invention is particularly suitably usable in an ink jet recording head and recording apparatus wherein thermal energy by an electrothermal transducer, laser beam or the like is used to cause a change of state of the ink to eject or discharge the ink. This is because high density of the picture elements and high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the abovementioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the mountable recording head it may be a sin to a single head corresponding to a single color ink, or may be plural heads corresponding to a plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquified at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal in present invention is applicable to other types of ink. In one of them, the temperature rise due to the thermal energy is positively prevented by consuming it for the state change of the ink from the solid state to the liquid state. Another ink material is solidified when it is left to prevent the evaporation of the ink. In either of the cases, the application of the recording signal producing thermal energy, the ink is liquified, and the liquified ink may be ejected. Another ink material may start to be solidified at the time when it reaches the recording material. The present invention is also applicable to such an ink material as is liquified by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such a computer or the like, as a copying apparatus combined with an image reader or the like, or as a facsimile machine having information sending and receiving functions.

As described in the foregoing, according to the present invention, an elastic partition wall is provided in the ink container or in the ink passage, and the partition wall is provided with a slit or slits normally closed but opened below a predetermined vacuum or higher, so that the pressure to the liquid in the nozzle of the recording head is maintained with a predetermined vacuum, to assure the ink supply to the recording head.

The opening and/or the closing action of the slit is assured by producing a difference in the tension in the partition wall by changing the thickness of the wall or selecting the configuration of the mount, or by using a member or members for limiting a direction of collapse of the partition wall.

By providing a recess at the inside of the partition wall at the slit, the opening and/or closing of the slit is assured.

By providing plural slits at an end of the partition wall, the opening and/or the closing of the slit is assured.

Accordingly, the valve function may be provided by the same material as the vacuum producing member, and the structure and assembling is simple.

As a result, the manufacturing cost can be reduced. In addition, the ink container occupies a small space. In addition, the ink can be stored as it is, thus permitting a large capacity ink container. The size of the ink cartridge can also be reduced. Simultaneously, almost all of the ink container is usable because the ink pressure to the nozzle is controlled within a predetermined range. The stabilized ink ejection is accomplished without leakage of the ink.

While the invention has been described with reference to the structures disclosed herein, it is not confined to the details set forth and this application is intended to cover such modifications or changes as may come within the purposes of the improvements or the scope of the following claims.

What is claimed is:

1. An ink container comprising:

a container body defining a space for accommodating ink;

an ink outlet for supplying the ink from said container body; and pressure control means for controlling pressure of the ink supply, said pressure control means having a valve covering the outlet, wherein said pressure control means is an elastic dome having a slit which is normally closed and opens when a differential pressured beyond a predetermined level is applied thereto.

2. A container according to claim 1, wherein said container is connected to a recording head for ejecting ink to effect a recording operation, said container supplying ink to the recording head, and wherein said pressure control means maintains a pressure of +30 mm.aq or lower to the recording head.

3. A container according to claim 1, wherein a plurality of said pressure control means are provided in series in said container body.

4. A container according to claim 1, further comprising limiting means for limiting deformation of said pressure control means in a predetermined direction.

5. A container according to claim 1, wherein said elastic dome includes a plurality of slits on a top of said dome, and is provided with limiting means for limiting deformation thereof in a predetermined direction, wherein said limiting means is provided by changing a wall thickness of said dome.

6. A container according to claim 5, wherein said limiting means includes a rib on said dome.

7. A container according to claim 5, wherein said limiting means includes an oval mount.

8. a container according to claim 1 wherein a recess is provided in an inside portion of said pressure control means adjacent the slit.

9. A container according to claim 1, wherein said pressure control means is provided with a plurality of slits crossing at predetermined angles with each other.

10. An ink jet head cartridge comprising;

a container body defining a space for accommodating ink;

an ink outlet for supplying the ink from said container body;

pressure control means for controlling pressure of the ink supply, said pressure control means having a valve covering the outlet, wherein said pressure control means is an elastic dome having a slit which is normally closed and opens when a differential pressured beyond a predetermined level is applied thereto; and a recording head supplied with the ink from said container for ejecting the ink.

11. An ink jet head cartridge according to claim 10, wherein said recording head uses thermal energy to eject the ink and comprises an electrothermal transducer element for generating thermal energy.

12. An ink jet apparatus comprising:

a container body defining a space for accommodating ink;

an ink outlet for supplying the ink from said container body;

pressure control means for controlling pressure of the ink supply, said pressure control means having a valve covering the outlet, wherein said pressure control means is an elastic dome having a slit which is normally closed and opens when a differential pressured beyond a predetermined level is applied thereto;

a recording head supplied with the ink from said container for ejecting the ink on a recording material;

a member for supporting said recording head; and feeding means for feeding the recording material.

13. An ink jet apparatus according to claim 12, wherein said recording head uses thermal energy to eject the ink and comprises an electrothermal transducer element for generating thermal energy.

* * * * *

UNITED STATES PATENT AND TRADEMARK OFFICE

CERTIFICATE OF CORRECTION

PATENT NO. : 5,270,739

DATED : December 14, 1993

INVENTOR(S) : MASASHI KITANI, ET AL.

It is certified that error appears in the above-identified patent and that said Letters Patent is hereby corrected as shown below:

ON TITLE PAGE

In [57] Abstract:
Line 2, "liquid," should read --liquid and--.
Line 3, "outlet" should read --outlet.--.

COLUMN 1

Line 9, "a" (second occurrence) should be deleted.
Line 13, "usable" should read --is usable--.
Line 59, "the" (first occurrence) should read --the vacuum--.

COLUMN 4

Line 57, "<=0" should read --≦0--.

COLUMN 5

Line 55, "in hardness" should read --in Japanese Industrial Standard (JIS) K6301, spring type hardness--.
Line 61, "tension viscosity," should read --tension, viscosity--.

COLUMN 6

Line 35, "antispetic" should read --antiseptic--.

COLUMN 7

Line 33, "inside" should read --inside and--.

UNITED STATES PATENT AND TRADEMARK OFFICE

CERTIFICATE OF CORRECTION

PATENT NO. : 5,270,739

DATED : December 14, 1993

INVENTOR(S) : MASASHI KITANI, ET AL.

It is certified that error appears in the above-identified patent and that said Letters Patent is hereby corrected as shown below:

COLUMN 8

Line 62, "shape" should read --shape of--.

COLUMN 9

Line 33, "closed." should read --close.--.

COLUMN 10

Line 9, "tube 205." should read --tube 205--.
Line 16, "gui" should read --guides--.
Line 21, "coming," should read --coming--.
Line 23, "the," should read --the--.

COLUMN 11

Line 9, "recovery" should read --recover--.

COLUMN 12

Line 34, "sin to a" should be deleted.
Line 53, "in" should read --in the--.

COLUMN 14

Line 19, "a container" should read --A container-- and "claim 1" should read --claim 1,--.

UNITED STATES PATENT AND TRADEMARK OFFICE

CERTIFICATE OF CORRECTION

PATENT NO. : 5,270,739

DATED : December 14, 1993

INVENTOR(S) : MASASHI KITANI, ET AL.

It is certified that error appears in the above-identified patent and that said Letters Patent is hereby corrected as shown below:

COLUMN 14

Line 25, "comprising;" should read --comprising:--.

Signed and Sealed this

Twelfth Day of July, 1994

Bruce Lehman

*Attest:*

BRUCE LEHMAN

*Attesting Officer*

*Commissioner of Patents and Trademarks*